US005311757A

United States Patent [19]

Spahn

[11] Patent Number: 5,311,757

[45] Date of Patent: May 17, 1994

[54] FLAT KEY WITH CIRCUIT CHIP

[75] Inventor: Karl-Heinz Spahn, Ostbevern, Fed. Rep. of Germany

[73] Assignee: Aug. Winkhaus GmbH & Co. KG, Telgte, Fed. Rep. of Germany

[21] Appl. No.: 27,688

[22] Filed: Mar. 8, 1993

[30] Foreign Application Priority Data

Mar. 6, 1992 [DE] Fed. Rep. of Germany ... 9202995[U]

[51] Int. Cl.[5] ..... E05B 19/04

[52] U.S. Cl. ..... 70/408; 70/278; 70/460; 235/492; 340/825.31

[58] Field of Search ..... 70/277, 278, 408, 413, 70/460, 395; 340/825.31; 235/492

[56] References Cited

U.S. PATENT DOCUMENTS

| | | | |
|---|---|---|---|
| 312,545 | 2/1885 | Zeilin | 70/408 |
| 2,653,492 | 9/1953 | Abrams | 70/408 |
| 4,077,242 | 3/1978 | Sedley | 70/413 |
| 4,102,166 | 7/1978 | Hughes | 70/456 R |
| 4,686,358 | 8/1987 | Seckinger et al. | 235/492 |
| 4,734,693 | 3/1988 | Dluhosch et al. | 340/825.31 |
| 4,888,970 | 12/1989 | Kinzler et al. | 70/408 X |
| 4,922,736 | 5/1990 | Tanaka et al. | 70/408 X |
| 4,924,686 | 5/1990 | Vonlanthen | 70/413 X |
| 5,038,590 | 8/1991 | Sawyer et al. | 70/408 X |
| 5,208,450 | 5/1993 | Uenishi et al. | 235/492 |

FOREIGN PATENT DOCUMENTS

| | | | |
|---|---|---|---|
| 3517858 | 11/1985 | Fed. Rep. of Germany . | |
| 3501482 | 7/1986 | Fed. Rep. of Germany . | |
| 3507871 | 1/1988 | Fed. Rep. of Germany . | |
| 3836458 | 5/1989 | Fed. Rep. of Germany . | |
| 8909907 | 11/1989 | Fed. Rep. of Germany . | |
| 3917549 | 12/1989 | Fed. Rep. of Germany . | |
| 4080482 | 3/1992 | Japan | 70/408 |

*Primary Examiner*—Lloyd A. Gall

*Attorney, Agent, or Firm*—Brumbaugh, Graves, Donohue & Raymond

[57] ABSTRACT

A flat key for or a lock which is coded mechanically as well as electronically, includes a flat basic shaped part (11) consisting of metal, with a shank section (9) and a bow section (13). A circuit chip (23), fitted with structural parts (25) of an electronic circuit, is in a recess (21) in the bow section, formed by an integral bottom (19) of the basic shaped part (11) and sealed by a casting compound (29). Housing shells (15, 17) surrounding the bow section (13) are on facing flat sides of the bow section (13). The housing shell (15) lying over the recess (21) is bonded to the bow section (13). The other housing shell (17) bears a U-shaped rib (43) by which it engages behind the bonded housing shell (15).

18 Claims, 1 Drawing Sheet

FLAT KEY WITH CIRCUIT CHIP

BACKGROUND OF THE INVENTION

The invention concerns a flat, key comprising a flat basic shaped part, typically consisting of metal and integrally comprising a bow section and a shank section with mechanical lock-control members. A circuit chip having structural elements of an electronic circuit is disposed in a recess of the bow section, and two housing shells, e.g., shaped parts of a synthetic material, are disposed on facing flat sides of the bow section and substantially completely surround the bow section.

It is known that an electronic circuit which, by inductive transmission means, for example, transmits code information to a control circuit assigned to a lock for additional locking control, may be integrated in the bow of a key which locks the lock tumblers mechanically. Thus, locking reliability of the lock may be enhanced. See German Patent Document DE-A-3,517,858.

German Patent Document DE-C-3,507,871 discloses a flat key whose flat basic shaped part, consisting of metal, forms a shank section and a bow section in one piece. In known fashion, the shank section includes mechanical lock-control members for controlling the tumblers of the lock, e.g., notches or depressions, and the bow section is substantially completely surrounded by two housing shells made as shaped parts of synthetic material disposed on facing flat sides of the bow section. The key comprises an electronic circuit whose structural elements are arranged on a circuit chip accommodated in a recess of the bow section of the basic shaped part, with the housing shells covering the recess.

SUMMARY OF THE INVENTION

It is an object of the invention to permanently protect the electronic circuit of a flat key.

In accordance with an aspect of the invention, a recess in a bow section of the key is closed toward a first one of two flat sides of the bow section by a bottom which is integral with the basic shaped part. The recess containing the circuit chip is filled with an insulating casting compound, and a housing shell disposed on the second one of the two flat sides is bonded to the basic shaped part along a bonding seam which sealingly surrounds the recess. Thus, the recess accommodating the circuit chip in its bow section forms a trough open on one side only, and is filled with a casting compound after insertion of the chip. The trough opening is then sealed off with the housing shell, which is bonded all around, so that the electronic circuit is permanently protected against dirt and moisture.

DETAILED DESCRIPTION OF PREFERRED EMBODIMENTS

Figure 1:
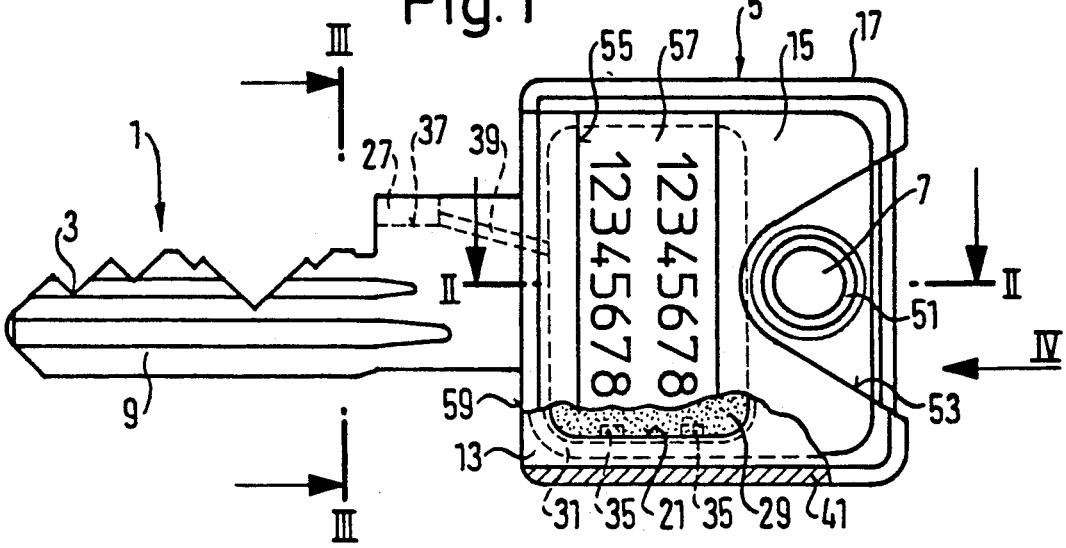
FIG. 1 is a view of a flat side of a flat key in accordance with a preferred embodiment of the invention.

In a preferred embodiment, the basic shaped part has a substantially uniform narrow-side thickness of the shank section and the bow section. Since this thickness should not exceed the dimensions of a conventional flat key, there may be instances of structural elements projecting beyond the flat sides of the bow section, and possibly even protruding from the casting compound. To accommodate such structural elements, the housing shell on the second flat side advantageously has a recess open toward the recess of the bow section. As the first housing shell (on the first flat side) does not have a protective function for the electronic circuit, it is advantageous to attach it to the second housing shell (on the second flat side), e.g., by utilizing the same bonding means as for the second housing shell. The second housing shell, which covers the trough-like recess of the bow section, advantageously has projections into the recess which facilitate positioning of the second housing shell on the bow section.

For the transmission of power and data, the electronic circuit may comprise structural elements such as an induction coil, for example, disposed outside the recess of the bow section. Advantageously, such structural elements are integrated into the shank section, so that associated read means, e.g., again, an induction coil, may be placed within the lock. In a preferred flat-key embodiment, in one of its flat sides the shank section has a recess for a structural element of the electronic circuit, longitudinally between its region with the lock control members and the bow section. The recesses of the shank section and of the bow section are connected by a bore oblique to the longitudinal direction of the shank section and completely within the basic shaped part, for receiving at least one electrical connecting line. Thus, the typically thin, sensitive connecting lines are permanently protected.

In accordance with a further aspect of the invention, which can also be used in flat keys other than those described above, the two housing shells are attached to one another and to the basic shaped part in a particularly convenient and lasting manner.

With reference to the prior-art flat key described hereinabove, this aspect involves one or more first fastening members for the housing shells, form-lockingly fixing the housing shells to one another. Furthermore, the bow section contains a key-ring hole on the side of the recess distant from the shank section, and a tubular, second fastening member fixes the two housing shells together through the hole. The first fastening members fix the housing shells together transverse to the flat sides, and the second fastening member fixes the unit so formed along the flat sides of the basic shaped part.

The first fastening members may comprise at least one rib on a first housing shell, projecting along the flat side and engaging behind the second housing shell on the side distant from the bow section. Particularly suitable are ribs engaging the second housing shell in U-shape fashion parallel to the flat side. Then, the first housing shell can be slipped on the second housing shell along the flat side, so that the rib engages behind the second housing shell in the direction of the shank section on both sides as well as on the side distant from the shank section. By this arrangement, the distance between the bow section and the region of the shank section projecting beyond the housing shells can be kept short, thereby providing for short connecting lines between the circuit chip and structural elements arranged in the key shank, without reducing the shank length insertable into the lock.

When the insertable length between the region of the lock-control members on the one hand and the bow section on the other is shortened by projection of the housing shells, complete insertion of the key into the lock may be impossible. This may be the case, e.g., in the presence of particularly massive security-lock fittings. In a preferred embodiment of the invention, insertable length is maximized as the sides of the housing shells near the shank section are substantially flush with the bow section adjoining the shank section on both sides.

Advantageously, the key-ring hole of the basic shaped part is a punched hole, as deburring is unnecessary when the housing shells are fastened as described.

Preferably, the second fastening member is a sleeve-like, hollow metallic rivet. The rivet forms a lining of the key-ring opening of the flat key, thus protecting shells consisting of synthetic material against damage by the key-ring.

Generally, flat keys as described are used for locking systems or the like and require hierarchical markings. German Patent Document 8,909,907 discloses a flat key with a groove, e.g., a dovetail groove, in the flat side of the bow section. The groove is open to the peripheral edge of the bow section, and the edges of the groove slant toward each other. An identification plate can be readily inserted into the groove from the peripheral edge, but the plate is not permanently secured in the groove.

Preferably, in accordance with an aspect of the invention, an identification plate is secured as follows:

One of the two housing shells ends substantially flush with the peripheral edge of the bow section, and the other housing shell engages around the peripheral edge of the bow section and has a rib engaging behind the first housing shell. Also, the rib closes off each groove end open toward the peripheral edge. As a result, the identification plate can be inserted upon assembly of the flat key and, in the assembled flat key, is held in the groove by the rib.

Figure 2:
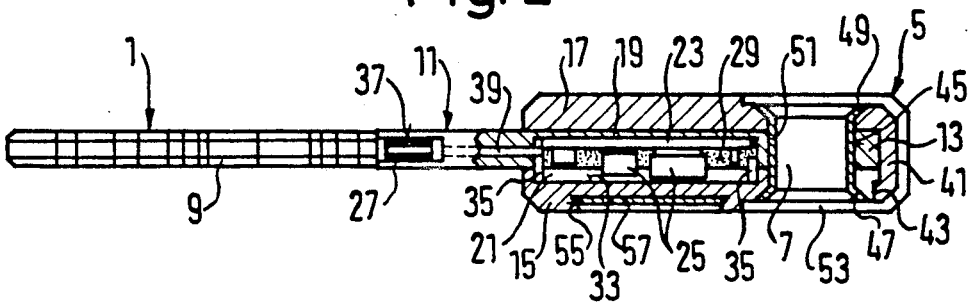
FIG. 2 is a cross section of the flat key of FIG. 1, along the line II—II.
Figure 3:
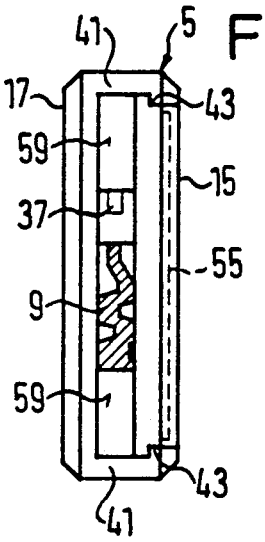
FIG. 3 is a cross section of the flat key of FIG. 1, along the line III—III.
Figure 4:
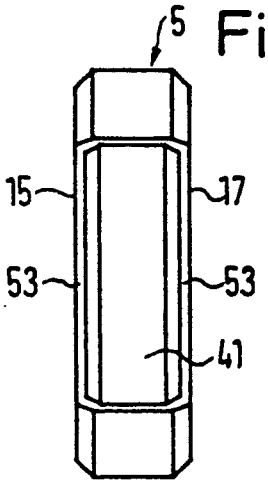
FIG. 4 is an end view of the flat key of FIG. 1, in the direction of the arrow IV.

As illustrated by FIG. 1-4, a flat key suitable for locking mechanical locks, in particular cylinder locks with additional electronically controlled security means, has a key shank 1 with mechanical lock-control members 3, e.g., in the form of notches, and a bow 5 with a key-ring opening 7. The key shank 1 is formed in a section 9 of a basic shaped part 11 which consists of metal and which also includes a substantially rectangular bow section 13. The basic shaped part 11 has a narrow-side thickness which is substantially constant over the shank section 9 and the bow section 13. The two flat sides of the bow section 13 are covered by housing shells 15, 17, which surround the bow section substantially completely. A circuit chip 23 comprising structural elements 25 of an electronic circuit for control of a lock (not shown) is disposed in a trough-like recess 21 of the bow section 13. The recess 21 is closed off toward one flat side by an integral bottom 19 of the basic shaped part 11. The electronic circuit is connected with a signal-transmission element 27, e.g., an induction coil, in the key shank 1 between the region of the lock-control members 3 and the bow 5, for transmission of code information between the flat key and the lock, and, preferably, also for transmission of the electrical power required for circuit operation.

To protect the circuit from dirt and moisture, the recess 21 is filled with an insulating casting compound 29. The periphery of the housing shell 15 which covers the recess 21 is flush with the peripheral edge of the bow section 13 and is bonded sealingly to the flat side of the bow section 13 by an annular bonding seam 31 around the recess 21. Opposite the recess 21, the housing shell 15 has a clearance 33 for the structural elements 25 which protrude beyond the flat side of the bow section 13. For further centering and alignment of the housing shell 15 relative to the bow section 13, a plurality of projections 35 project from the housing shell 15 into the recess 21. The housing shell 15, the bottom 19 of the bow section 13, and the casting compound 29 contribute to the mechanically sturdy and permanently protected accommodation of the electronic circuit in the bow 5.

The induction coil 27 is disposed in a recess 37 in the narrow side of the shank section 9, limited toward the flat sides by integral side walls of the shank section 9. A bore 39, oblique to the longitudinal direction of the shank section 9, connects the recesses 21 and 37. The bore 39 accommodates and protects electrical connecting lines which connect the induction coil 27 with the circuit chip 23. The bore 39 runs entirely inside the basic shaped part 11. For protection of the induction coil 27, the recess 37 is likewise filled with insulating casting compound.

The housing shell 17 adjacent to the bottom 19 of the recess 21 surrounds the peripheral edge of the bow section 13 as well as the housing shell 15 with a peripheral wall 41, U-shaped in the top view of the flat side, on the two edges in the longitudinal direction of the shank section 9 as well as on the edge transverse thereto on the side distant from the shank section 9. A rib 43, likewise following the U-shaped contour, projects from the edge of the peripheral wall 41, parallel to the flat sides of the bow section 13, and engaging a complementary groove of the housing shell 15. Thus, the housing shell 17 can be slipped onto the bow section 13 and the housing shell 15 in the longitudinal direction of the shank section 9 from the side distant from the shank section 9, the rib 43 fixing the housing shell 17 transverse to the flat side directly to the housing shell 15 bonded to the basic shaped part 11.

On the side of the recess 21 distant from the shank section 9, a hole 45 is punched in the bow section 13, opposite holes 47, 49 in the housing shells 15, 17. A sleeve-shaped hollow rivet 51 extends through the holes 45, 47, 49 and fixes the housing shells 15, 17 to one another as well as to the bow section 13. The hollow rivet, consisting of metal, also protects the housing shells 15, 17 from damage by the key ring. To reduce the thickness of the narrow sides of the bow 5 in the region of the key-ring opening 7, the housing shells 15, 17 are flattened by depressions 53.

On its outer side, the housing shell 15 has a dovetail groove 55 transverse to the longitudinal direction of the shank, and an identification plate 57 with a key marking is inserted in the groove 55. The groove 55 has parallel, sloping edges which engage the identification plate 57. The groove 55 is open toward the facing peripheral edges of the housing shell 15, for easy insertion of the identification plate 57 before assembly of the housing shell 17. In the assembled flat key, the rib 43 engages in front of the open front ends of the groove 55 and closes off the front ends.

The maximum usable length of the shank section 9 is delimited by the front edges 59 of the bow section 13, directly adjoining the shank section 9 and perpendicular to the longitudinal direction of the shank. In order not to reduce the maximum usable length of the shank section 9, the two housing shells 15, 17 terminate flush with the front edges 59 of the bow section 13.

I claim:

1. A flat key comprising a flat basic shaped part (11) having a shank section (9) including mechanical lock-control members (3) and a bow section (13), a circuit chip (23) with structural elements (25) of an electronic circuit disposed in a recess (21) of the bow section (13), and two housing shells (15, 17) substantially completely surrounding the bow section (13) and disposed on facing flat sides of the bow section (13), wherein the recess (21) is closed toward a first one of the two flat sides of the bow section (13) by a bottom (19) formed integrally by the basic shaped part (11), the recess (21) with the circuit chip (23) is filled with an insulating casting compound (29), the housing shell (15) on the second one of the two flat sides is bonded to the basic shaped part (11) along a bonding seam (31) sealingly surrounding the recess (21).

2. The flat key of claim 1, wherein the basic shaped part (11) consists essentially of metal and the two housing shells (15, 17) consist essentially of synthetic material.

3. The flat key of claim 1, wherein the housing shell (17) disposed on the first flat side is attached to the other housing shell (15) by fastening means (43).

4. The flat key of claim 1, wherein the housing shell (15) disposed on the second flat side has a clearance (33) open toward the recess (21) of the bow section (13).

5. The flat key according of claim 1, wherein the housing shell (15) disposed on the second flat side has projections (35) projecting into the recess (21) of the bow section (13).

6. The flat key of claim 1, wherein the shank section (9), in the longitudinal direction between its region having the lock-control members (3) and the bow section (13), has a recess (37) in one of its flat sides, in which a structural element (27) of the electronic circuit is disposed, and wherein the recess (21, 37) of the shank section (9) and the bow section (13) are connected to one another by a bore (39) transverse to the longitudinal direction of the shank section (9) and entirely within the material of the basic shaped part (11), for accommodation of at least one electrical line.

7. The flat key of claim 1, wherein one (15) of the two housing shells (15, 17) ends substantially flush with the peripheral edge of the bow section (13), and the other housing shell (17) engages around the peripheral edge of the bow section (13) and has a rib (43) engaging behind the first housing shell (15).

8. The flat key of claim 7, wherein the one housing shell (15), on its side distant from the bow section (13), has a groove (55) extending transverse to the direction of the shank section (9) and open towards the peripheral edge of said one housing shell lies on at least one side, with groove edges extending parallel to one another and converging outward towards one another, wherein an identification plate (57) is in the groove (55), and wherein each groove end open toward the peripheral edge is closed off by the rib (43).

9. The flat key of claim 1, wherein a peripheral contour of the two housing shells (15, 17), on the side toward the shank section (9), ends substantially flush with the regions (59) of the peripheral edge of the bow section (13) surrounding the shank section (9) on both sides.

10. A flat key comprising a flat basic shaped part (11) having a shank section (9) including mechanical lock-control members (3) and a bow section (13), a circuit chip (23) with structural elements (25) of an electronic circuit, disposed in a recess (21) of the bow section (13), and two housing shells (15, 17) substantially completely surrounding the bow section (13) and disposed on facing flat sides of the bow section (13), wherein the housing shells (15, 17) have first fastening members (43) for fixing the housing shells (15, 17) form-lockingly directly to one another, the bow section (13) has a key-ring hole (45) on the side of the recess (21) distant from the shank section (9), a tubular, second fastening member (51) fixes the two housing shells (15, 17) to one another through the hole (45).

11. The flat key of claim 10, wherein the first fastening members have a rib (43), projecting along a flat side of a first one (17) of the two housing shells, engaging behind the second housing shell (15) on the side distant from the bow section (13).

12. The flat key of claim 11, wherein the rib (43) engages in U-fashion about the second housing shell (15), parallel to the flat side.

13. The flat key of claim 12, wherein the rib (43) engages behind the second housing shell (15) in the direction of the shank section (9) on both sides as well as on the side distant from the shank section (9), so that the first housing shell (17) is capable of being slipped on the second housing shell (15) toward the shank section (9).

14. The flat key of claim 10, wherein the second fastening member is a sleeve-shaped hollow metallic rivet (51).

15. The flat key of claim 10, wherein the key-ring hole of the basic shaped part (11) is a punched hole.

16. The flat key of claim 10, wherein one (15) of the two housing shells (15, 17) ends substantially flush with the peripheral edge of the bow section (13), and the other housing shell (17) engages around the peripheral edge of the bow section (13) and has a rib (43) engaging behind the first housing shell (15).

17. The flat key of claim 16, wherein the one housing shell (15), on its side distant from the bow section (13), has a groove (55) extending transverse to the longitudinal direction of the shank section (9) and open towards the peripheral edge of said one housing shell (15) on at least one side, with groove edges extending parallel to one another and converging outward towards one another, wherein an identification plate (57) is in the groove (55), and wherein each groove end open toward the peripheral edge is closed off by the rib (43).

18. The flat key of claim 10, wherein a peripheral contour of the two housing shells (15, 17), on the side toward the shank section (9), ends substantially flush with the regions (59) of the peripheral edge of the bow section (13) surrounding the shank section (9) on both sides.

* * * * *

UNITED STATES PATENT AND TRADEMARK OFFICE

CERTIFICATE OF CORRECTION

PATENT NO. : 5,311,757

DATED : May 17, 1994

INVENTOR(S) : Karl-Heinz Spahn

It is certified that error appears in the above-indentified patent and that said Letters Patent is hereby corrected as shown below:

Col. 5, line 60, "lies" should read --(15)--.

Signed and Sealed this

Thirty-first Day of January, 1995

Bruce Lehman

*Attest:*

BRUCE LEHMAN

*Attesting Officer*

*Commissioner of Patents and Trademarks*